US009333518B2

(12) United States Patent
Short

(10) Patent No.: US 9,333,518 B2
(45) Date of Patent: May 10, 2016

(54) MULTIPOINT INJECTORS

(71) Applicant: Delavan Inc, West Des Moines, IA (US)

(72) Inventor: John Earl Short, Norwalk, IA (US)

(73) Assignee: Delavan Inc, West Des Moines, IA (US)

( * ) Notice: Subject to any disclaimer, the term of this patent is extended or adjusted under 35 U.S.C. 154(b) by 456 days.

(21) Appl. No.: 13/779,323

(22) Filed: Feb. 27, 2013

(65) Prior Publication Data

US 2014/0239095 A1 Aug. 28, 2014

(51) Int. Cl.

| | |
|---|---|
| ***B05B 7/08*** | (2006.01) |
| ***B05B 1/34*** | (2006.01) |
| ***B05B 1/14*** | (2006.01) |

(52) U.S. Cl.

CPC ..... *B05B 1/3442* (2013.01); *B05B 1/14* (2013.01)

(58) Field of Classification Search

CPC ..... B05B 7/08; B05B 7/10; B05B 7/0846; B05B 7/06

USPC ..... 239/398–405, 466, 468, 472, 463, 556, 239/558, 589, 596, 598, 590.5, 590.3, 239/589.1; 60/740–748

See application file for complete search history.

(56) References Cited

U.S. PATENT DOCUMENTS

| | | | |
|---|---|---|---|
| 2,607,193 | A | 8/1952 | Berggren et al. |
| 3,680,793 | A | 8/1972 | Tate et al. |
| 4,598,553 | A | 7/1986 | Saito et al. |
| 5,409,169 | A | 4/1995 | Saikalis et al. |
| 5,713,206 | A | 2/1998 | McWhirter et al. |
| 6,092,363 | A | 7/2000 | Ryan |
| 6,360,525 | B1 | 3/2002 | Senior et al. |
| 6,363,726 | B1 | 4/2002 | Durbin et al. |
| 6,533,954 | B2 | 3/2003 | Mansour et al. |
| 6,547,163 | B1 * | 4/2003 | Mansour et al. ..... 239/404 |
| 6,622,488 | B2 | 9/2003 | Mansour et al. |
| 6,688,534 | B2 | 2/2004 | Bretz |
| 6,755,024 | B1 | 6/2004 | Mao et al. |
| 6,854,670 | B2 | 2/2005 | Sumisha et al. |
| 6,863,228 | B2 | 3/2005 | Mao et al. |
| 7,454,914 | B2 | 11/2008 | Prociw |
| 7,509,811 | B2 | 3/2009 | Chen et al. |
| 7,520,134 | B2 | 4/2009 | Durbin et al. |
| 7,533,531 | B2 | 5/2009 | Prociw et al. |
| 7,926,178 | B2 | 4/2011 | Thomson et al. |

(Continued)

OTHER PUBLICATIONS

R. Tacina et al. "Experimental Investigation of a Multiplex Fuel Injector Module With Discrete Jet Swirlers for Low Emission Combustors," NASA/TM-2004-212918; AIAA-2004-0185 (2004).

(Continued)

*Primary Examiner* — Ryan Reis
*Assistant Examiner* — Viet Le
(74) *Attorney, Agent, or Firm* — Locke Lord LLP; Scott D. Wofsy; Joshua L. Jones

(57) ABSTRACT

A multipoint injector includes a nozzle body defining a fluid inlet in fluid communication with a plurality of feed bores. A plurality of swirl chambers is defined radially outward from the fluid inlet of the nozzle body in fluid communication with the fluid inlet through the feed bores. A plurality of injection orifices are respectively aligned in fluid communication with the swirl chambers for issuing a swirling spray of fluid passing from each swirl chamber through each injection orifice.

13 Claims, 3 Drawing Sheets

(56) References Cited

U.S. PATENT DOCUMENTS

| | | | | |
|---|---|---|---|---|
| 7,926,282 | B2 | 4/2011 | Chew et al. | |
| 8,313,046 | B2 | 11/2012 | Short | |
| 2009/0255258 | A1 | 10/2009 | Bretz et al. | |
| 2011/0031333 | A1 * | 2/2011 | Short | 239/548 |
| 2012/0292408 | A1 | 11/2012 | Short | |
| 2013/0036741 | A1 | 2/2013 | Prociw | |

OTHER PUBLICATIONS

C. Lee et al., "High Pressure Low Nox Emissions Research: Recent Progress at NASA Glenn Research Center," ISABE-2007-1270 (2007).

K. M. Tacina et al. "NASA Glenn High Pressure Low NOX Emissions Research," NASA/TM-2008-214974 (2008).

* cited by examiner 102
104
114
110
110
110
100
3
4
4
112
110
110
3

104
114
A
102
5
A
110
110
110
112
122

Fig. 3
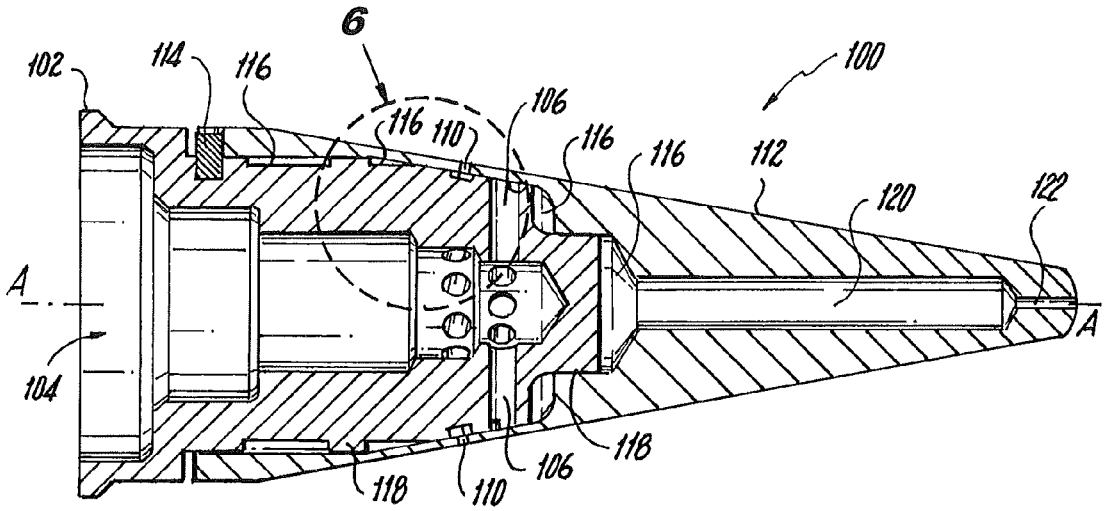
Fig. 5
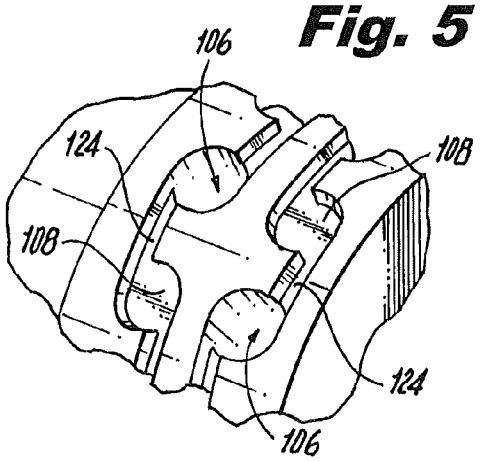
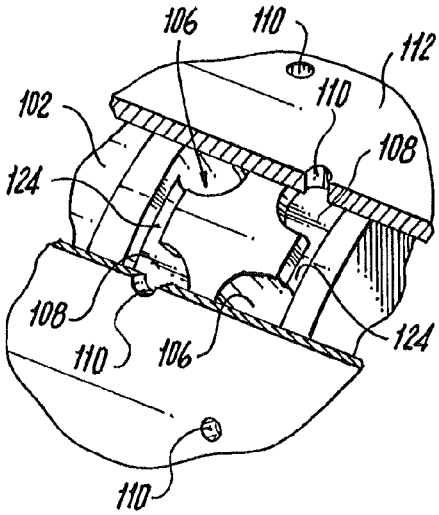
Fig. 4
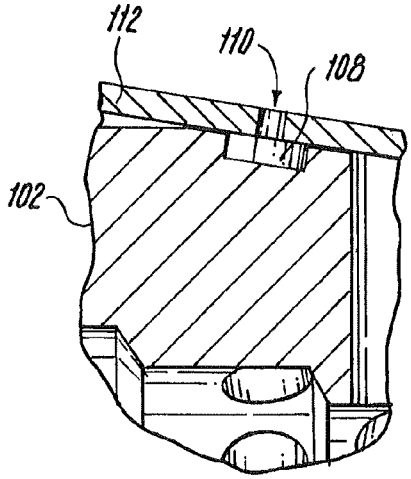
Fig. 6

MULTIPOINT INJECTORS

BACKGROUND OF THE INVENTION

1. Field of the Invention

The present invention relates to injectors and nozzles, and more particularly to multipoint injectors and nozzles.

2. Description of Related Art

Enabling the breakup of large liquid bulk flow into finely atomized droplets has always been a challenge, particularly in fuel injection applications. For simplex pressure atomizers, in order to obtain high flow rates, the liquid supply pressure must increase dramatically, or the orifice must be enlarged. Often high pressure is not feasible, and droplets get larger as the orifice diameter increases. Air assist or prefilming air-blast nozzles are commonly used to atomize sprays when pressurized air is available. The air-blast method relies on the shearing effect of high velocity air to provide atomization. Often, an upstream trim orifice is incorporated which aids in flow calibration. The pressure drop taken across the trim orifice wastes energy which could potentially be used for atomization. In some cases, multiple injection points have been employed to disperse a flow, reducing each stream to a more manageable volume.

Such conventional methods and systems have generally been considered satisfactory for their intended purpose. However, there is still a need in the art for multipoint fuel injection that allows for improved spray patternation. There also remains a need in the art for multipoint injectors with improved manufacturability. The present invention provides a solution for these problems.

SUMMARY OF THE INVENTION

The subject invention is directed to a new and useful multipoint injector. The multipoint injector includes a nozzle body defining a fluid inlet in fluid communication with a plurality of feed bores. A plurality of swirl chambers is defined radially outward from the fluid inlet of the nozzle body in fluid communication with the fluid inlet through the feed bores. A plurality of injection orifices are respectively aligned in fluid communication with the swirl chambers for issuing a swirling spray of fluid passing from each swirl chamber through each injection orifice.

In certain embodiments, the plurality of swirl chambers is defined on a radially outward surface of the nozzle body, and a nozzle tip is mounted to the nozzle body. The nozzle tip defines the plurality of injection orifices, with each injection orifice aligned in fluid communication with a respective one of the swirl chambers.

In accordance with certain embodiments, each respective swirl chamber is in fluid communication with a respective one of the feed bores through a tangential feed slot configured to convey fluid from the feed bore into the swirl chamber to induce swirl on fluids within the swirl chamber. It is also contemplated that each respective swirl chamber can be in fluid communication with two opposed tangential feed slots each in fluid communication with a separate one of the feed bores. The feed slots can be configured to convey fluid from the feed bores into the swirl chamber to induce swirl on fluids within the swirl chambers.

The swirl chambers and feed slots can form a circumferential channel all the way around the nozzle body. There can be circumferential pattern around the circumferential channel with one feed bore between each adjacent pair of swirl chambers, and with one swirl chamber between each adjacent pair of feed bores.

In certain embodiments, the circumferential channel is at a first axial location on the nozzle body, and a second circumferential channel is at a second axial location spaced apart from the first axial location. The second circumferential channel can include a plurality of swirl chambers and respective feed bores in fluid communication through respective feed slots. It is also contemplated that the nozzle tip can include a respective injection orifice in fluid communication with each swirl chamber of the second circumferential channel.

It is contemplated that the feed bores of the second circumferential channel can be in fluid communication with the fluid inlet of the nozzle body, both circumferential channels forming a single injection circuit. It is also contemplated that the feed bores of the second circumferential channel can be in fluid isolation from the feed bores of the circumferential channel at the first axial location, with the first and second circumferential channels forming separate injection circuits.

The swirl chambers and injection orifices of the circumferential channel at the first axial location can be circumferentially offset from the swirl chambers and injection orifices of the second circumferential channel for providing a substantially uniform spray distribution circumferentially. Each of the circumferential channels can include eight swirl chambers for a total of sixteen swirl chambers, and the nozzle tip can include sixteen injection orifices corresponding to the sixteen swirl chambers of the nozzle body. Any other suitable number of swirl chambers and injection orifices can be used as well.

In accordance with certain embodiments, the multipoint injector can include a timing pin aligning the swirl chambers of the nozzle body to the respective injection orifices of the nozzle tip. One or more heat shielding pockets can be defined between the nozzle body and the nozzle tip. One or more braze joints can mount the nozzle body to the nozzle tip. The nozzle tip can define a central bore with a vent for venting the central bore. It is also contemplated that the feed bores can each be defined radially relative to an axis defined by the fluid inlet.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 3 is a cross-sectional side elevation view of the multipoint injector of FIG. 1, showing the internal flow circuit;

FIG. 4 is a cut away perspective view of a portion of the multipoint injector of FIG. 1, showing the alignment of the swirl chambers and injection orifices;

FIG. 5 is a perspective view of a portion of the nozzle body of FIG. 4, showing the circumferential channels around the nozzle body with the tip removed from the nozzle body;

FIG. 6 is a cross-sectional side elevation view of the multipoint injector of FIG. 4, showing the alignment of one of the swirl chambers with one of the injection orifices;

DETAILED DESCRIPTION OF THE PREFERRED EMBODIMENTS

Figure 1:
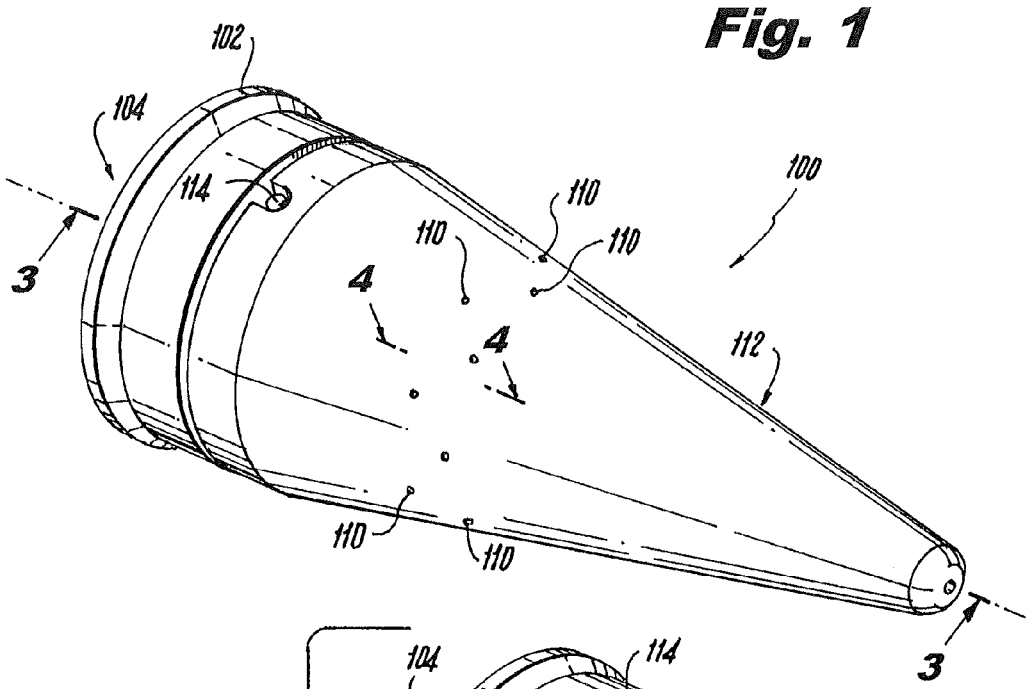
FIG. 1 is a perspective view of an exemplary embodiment of a multipoint injector constructed in accordance with the present invention, showing the injection points.

Reference will now be made to the drawings wherein like reference numerals identify similar structural features or aspects of the subject invention. For purposes of explanation and illustration, and not limitation, a partial view of an exemplary embodiment of a multipoint injector in accordance with the invention is shown in FIG. 1 and is designated generally by reference character 100. Other embodiments of multipoint injectors in accordance with the invention, or aspects thereof, are provided in FIGS. 2-8, as will be described. The systems and methods of the invention can be used to improve spray pattern and manufacturability for injection applications such as fuel injection in gas turbine engines.

Figure 2:
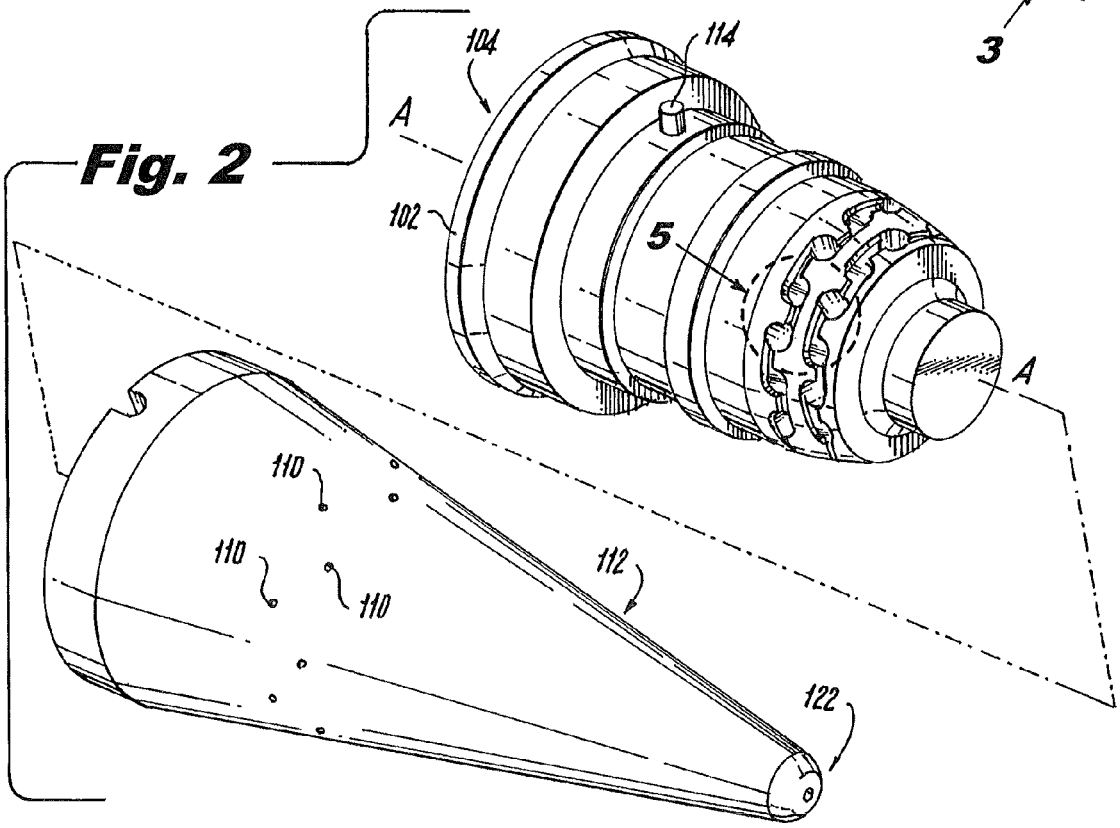
FIG. 2 is an exploded perspective view of the multipoint injector of FIG. 1, showing the tip removed from the nozzle body.
Figure 7:
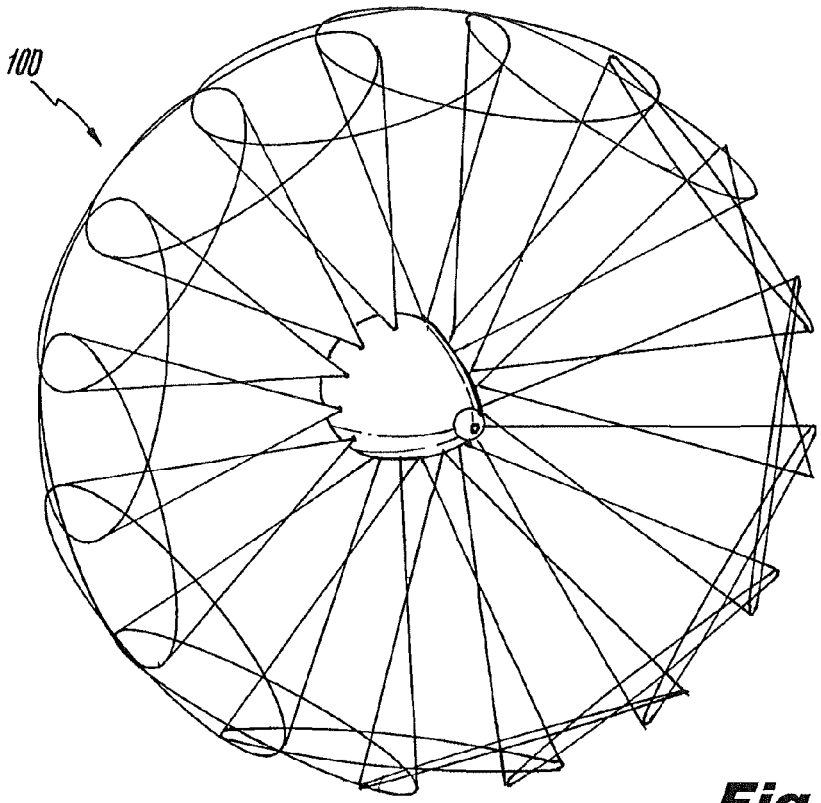
FIG. 7 is a perspective view of the multipoint injector of FIG. 1, schematically showing the spray pattern from the injection orifices.

With reference now to FIGS. 1-3, multipoint injector 100 includes a nozzle body 102 defining a fluid inlet 104 in fluid communication with a plurality of feed bores 106. Referring to FIG. 4, a plurality of swirl chambers 108 is defined radially outward from fluid inlet 104, which are also shown but not labeled in FIG. 2. Swirl chambers 108 are defined on a radially outward surface of nozzle body 102. As shown in FIGS. 3 and 4, swirl chambers 108 are each in fluid communication with fluid inlet 104 through feed bores 106. Feed bores 106 are each defined radially relative to an axis A defined by the fluid inlet, however any other suitable angle can be used for feed bores 106 relative to axis A. A plurality of injection orifices 110 are respectively aligned in fluid communication with swirl chambers 108 for issuing a swirling spray of fluid passing from each swirl chamber 108 through each injection orifice 110.

Referring again to FIGS. 1 and 2, a nozzle tip 112 is mounted to nozzle body 102, and injection orifices 110 are defined through the wall of nozzle tip 112. Each injection orifice 110 is aligned in fluid communication with a respective one of the swirl chambers 108, as shown in FIGS. 4 and 6. In order to assist in this alignment, a timing pin 114 can be used during assembly of nozzle tip 112 onto nozzle body 102. Optional heat shielding pockets 116, identified in FIG. 3, are defined by pockets between nozzle body 102 and nozzle tip 112. There are three heat shielding pockets 116 shown in FIG. 3, however, those skilled in the art will readily appreciate that any suitable number of heat shielding pockets can be used. Two braze joints 118 mount nozzle body 102 to nozzle tip 112. Those skilled in the art will readily appreciate that this braze configuration is exemplary only, and that any other suitable number of braze joints can be used, and that any other suitable joining technique besides brazing can be used. Nozzle tip 112 defines an optional central bore 120 with a vent 122 for venting central bore 120. Central bore 120 and vent 112 are optional, however they provide reduced thermal mass and a means to vent the central bore 120 to reduce unwanted pressure differentials on the braze joint 118 nearest central bore 120.

Referring now to FIG. 5, each respective swirl chamber 108 is in direct fluid communication each neighboring feed bore 106 through a tangential feed slot 124 configured to convey fluid from the feed bore 106 into the swirl chamber 108. Since feed slots 124 are tangential relative to the respective swirl chambers 108, swirl is induced on fluids passing into each swirl chamber 108 from the respective feed slots 124. The swirl on fluids within swirl chambers 108 is imparted on the sprays issuing from injection orifices 110, which improves atomization.

The swirl chambers 108, feed bores 106, and feed slots 124 form two complete circumferential channels all the way around the circumference of nozzle body 102, as shown in FIG. 2. Each complete circumferential channel allows all of the respective swirl chambers 108 to receive an even volume of the flow. There is a circumferential pattern around each circumferential channel with one feed bore 106 between each adjacent pair of swirl chambers 108. It can also be said that one swirl chamber 108 is between each adjacent pair of feed bores 106. While shown and described with the exemplary number of two circumferential channels, those skilled in the art will readily appreciate that any other suitable number of circumferential channels, including one, can be used as appropriate for a given application. Also, any other suitable circumferential pattern can be used, including patterns that do not connect into a channel all the way around the circumference of the nozzle body. For example, each swirl chamber can be feed by a single feed bore and feed slot, without being connected to the other swirl chambers in a circumferential channel.

As oriented in FIG. 2, the circumferential channel that is at left-most axial location on the nozzle body along axis A has eight swirl chambers 108 and eight feed bores 106. The second circumferential channel, namely the right-most along axis A as oriented in FIG. 2, also includes eight each of swirl chambers 108 and feed bores 106. Nozzle tip 112 includes a respective injection orifice 110 in fluid communication with each swirl chamber 108 of each of the circumferential channels for a total of sixteen injection orifices 110.

The swirl chambers 108 and injection orifices 110 of the left-most circumferential channel in FIG. 2 are circumferentially offset from the swirl chambers 108 and injection orifices 110 of the right-most circumferential channel for providing a substantially uniform spray distribution circumferentially. The spray pattern formed by the sixteen injection orifices 110 is shown schematically in FIG. 7. While the exemplary configuration described above includes sixteen injection orifices 110, those skilled in the art will readily appreciate that any other suitable number of swirl chambers and injection orifices can be used as well.

Figure 8:
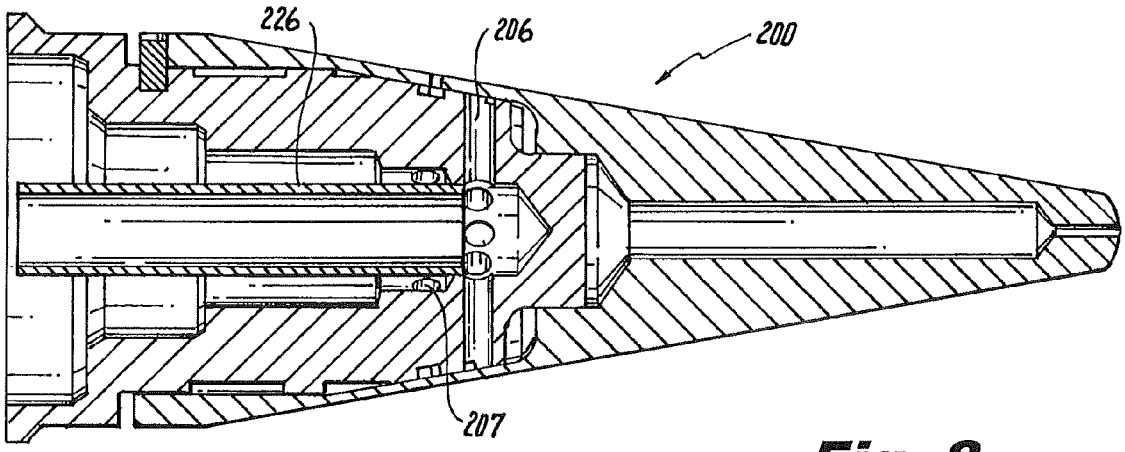
FIG. 8 is a cross-sectional side elevation view of another exemplary embodiment of a multipoint injector, showing a divider in the inlet of the nozzle body for separating flow to the injection orifices into two separate flow circuits.

With reference now to FIG. 8, another exemplary embodiment of a multipoint injector 200 includes two separate fluid circuits. Multipoint injector 100 described above has both circumferential channels in fluid communication with the fluid inlet 104 of the nozzle body 102, with both circumferential channels forming a single injection circuit. In contrast, in multipoint injector 200 of FIG. 8, an isolation cylinder 226 separates the right-most feed bores 206 corresponding to the right-most circumferential channel shown in FIG. 2 from the feed bores 207 of the other circumferential channel. This fluid isolation between the two sets of feed bores 206 and 207 allows for two separate injection circuits, so that eight of the injection orifices 210 can be operated independently of the other eight. This can allow for staging the two sets of injection orifices 210 separately, and can even allow for two separate fuels to be used at the same time or in stages. It is contemplated, for example, that a liquid fuel can be used in one circuit and a gaseous fuel can be used in the other circuit.

While described above with exemplary embodiments of multipoint injectors used for liquid fuels, those skilled in the art will readily appreciate that gaseous fuels can be used in addition to or in lieu of liquid fuels. Also, while shown and described in the exemplary context of gas turbine engines, those skilled in the art will readily appreciate multipoint injectors as described herein can be used in any suitable application.

The methods and systems of the present invention, as described above and shown in the drawings, provide for multipoint injection with superior properties including improved spray patternation and manufacturability. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A multipoint injector comprising:

a nozzle body defining a fluid inlet in fluid communication with a plurality of feed bores, wherein a plurality of swirl chambers is defined on a radially outward surface of the nozzle body in fluid communication with the fluid inlet through the feed bores; and a nozzle tip mounted to the nozzle body, wherein the nozzle tip defines a plurality of injection orifices, each injection orifice aligned in fluid communication with a respective one of the swirl chambers for issuing a swirling spray of fluid passing from the swirl chamber through the injection orifice, wherein each respective swirl chamber is in fluid communication with two opposed tangential feed slots each in fluid communication with a separate one of the feed bores, wherein the feed slots are configured to convey fluid from the feed bores into the swirl chambers to induce swirl on fluids within the swirl chambers, wherein the swirl chambers and feed slots form a circumferential channel all the way around the nozzle body, and wherein there is a circumferential pattern around the circumferential channel with one feed bore between each adjacent pair of swirl chambers, and with one swirl chamber between each adjacent pair of feed bores.

2. A multipoint injector comprising:

a nozzle body defining a fluid inlet in fluid communication with a plurality of feed bores, wherein a plurality of swirl chambers is defined on a radially outward surface of the nozzle body in fluid communication with the fluid inlet through the feed bores; and a nozzle tip mounted to the nozzle body, wherein the nozzle tip defines a plurality of injection orifices, each injection orifice aligned in fluid communication with a respective one of the swirl chambers for issuing a swirling spray of fluid passing from the swirl chamber through the injection orifice, wherein each respective swirl chamber is in fluid communication with two opposed tangential feed slots each in fluid communication with a separate one of the feed bores, wherein the feed slots are configured to convey fluid from the feed bores into the swirl chambers to induce swirl on fluids within the swirl chambers, wherein the swirl chambers and feed slots form a circumferential channel all the way around the nozzle body, and wherein the circumferential channel is at a first axial location on the nozzle body, and wherein a second circumferential channel is at a second axial location spaced apart from the first axial location, the second circumferential channel including a plurality of swirl chambers and respective feed bores in fluid communication through respective feed slots, and wherein the nozzle tip includes a respective injection orifice in fluid communication with each swirl chamber of the second circumferential channel.

3. A multipoint injector as recited in claim 2, wherein the feed bores of the second circumferential channel are in fluid communication with the fluid inlet of the nozzle body, both circumferential channels forming a single injection circuit.

4. A multipoint injector as recited in claim 2, wherein the feed bores of the second circumferential channel are in fluid isolation from the feed bores of the circumferential channel at the first axial location, with the first and second circumferential channels forming separate injection circuits.

5. A multipoint injector as recited in claim 2, wherein the swirl chambers and injection orifices of the circumferential channel at the first axial location are circumferentially offset from the swirl chambers and injection orifices of the second circumferential channel for providing a substantially uniform spray distribution circumferentially.

6. A multipoint injector as recited in claim 2, wherein each of the circumferential channels includes eight swirl chambers for a total of sixteen swirl chambers, and wherein the nozzle tip includes sixteen injection orifices corresponding to the sixteen swirl chambers of the nozzle body.

7. A multipoint injector as recited in claim 1, further comprising a timing pin aligning the swirl chambers of the nozzle body to the respective injection orifices of the nozzle tip.

8. A multipoint injector as recited in claim 1, wherein at least one heat shielding pocket is defined between the nozzle body and the nozzle tip.

9. A multipoint injector as recited in claim 1, wherein at least one braze joint mounts the nozzle body to the nozzle tip.

10. A multipoint injector as recited in claim 1, wherein the nozzle tip defines a central bore with a vent for venting the central bore.

11. A multipoint injector as recited in claim 1, wherein the feed bores are each defined radially relative to an axis defined by the fluid inlet.

12. A multipoint injector comprising:

a nozzle body defining a fluid inlet in fluid communication with a plurality of feed bores, wherein a plurality of swirl chambers is defined radially outward from the fluid inlet of the nozzle body in fluid communication with the fluid inlet through the feed bores, and wherein a plurality of injection orifices are respectively aligned in fluid communication with the swirl chambers for issuing a swirling spray of fluid passing from each swirl chamber through each injection orifice, wherein each respective swirl chamber is in fluid communication with two opposed tangential feed slots each in fluid communication with a separate one of the feed bores, wherein the feed slots are configured to convey fluid from the feed bores into the swirl chambers to induce swirl on fluids within the swirl chambers, wherein the swirl chambers and feed slots form a circumferential channel all the way around the nozzle body, and wherein there is a circumferential pattern around the circumferential channel with one feed bore between each adjacent pair of swirl chambers, and with one swirl chamber between each adjacent pair of feed bores.

13. A multipoint injector comprising:

a nozzle body defining a fluid inlet in fluid communication with a plurality of feed bores, wherein a plurality of swirl chambers is defined radially outward from the fluid inlet of the nozzle body in fluid communication with the fluid inlet through the feed bores, and wherein a plurality of injection orifices are respectively aligned in fluid communication with the swirl chambers for issuing a swirling spray of fluid passing from each swirl chamber through each injection orifice, wherein each respective swirl chamber is in fluid communication with two opposed tangential feed slots each in fluid communication with a separate one of the feed bores, wherein the feed slots are configured to convey fluid from the feed bores into the swirl chambers to induce swirl on fluids within the swirl chambers, wherein the swirl chambers and feed slots form a circumferential channel all the way around the nozzle body, and wherein the circumferential channel is at a first axial location on the nozzle body, and wherein a second circumferential channel is at a second axial location spaced apart from the first axial location, the second circumferential channel including a plurality of swirl chambers and respective feed bores in fluid communication through respective feed slots, and wherein the nozzle tip includes a respective injection orifice in fluid communication with each swirl chamber of the second circumferential channel.

* * * * *